US007339328B2

(12) United States Patent
Tehori et al.

(10) Patent No.: US 7,339,328 B2
(45) Date of Patent: Mar. 4, 2008

(54) METHOD OF SHAPING LIGHT PULSES EMITTED BY AN ARC LAMP

(75) Inventors: Ahikam Tehori, Nahariya (IL); Alexander Rotman, Nazareth Illit (IL); Yitzhak Shraga, Nahariya (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 102 days.

(21) Appl. No.: 11/177,424

(22) Filed: Jul. 11, 2005

(65) Prior Publication Data

US 2006/0017400 A1 Jan. 26, 2006

(30) Foreign Application Priority Data

Jul. 11, 2004 (IL) ..... 162961

(51) Int. Cl.
*H05B 41/16* (2006.01)
*H05B 37/02* (2006.01)

(52) U.S. Cl. ..... 315/246; 315/360

(58) Field of Classification Search ..... 315/209 R, 315/246, 247, 291, 307, 360, 362
See application file for complete search history.

(56) References Cited

U.S. PATENT DOCUMENTS 5,754,011 A * 5/1998 Frus et al. ..... 315/209 SC
6,888,319 B2 * 5/2005 Inochkin et al. ..... 315/243

* cited by examiner

*Primary Examiner*—Thuy Vinh Tran
(74) *Attorney, Agent, or Firm*—Mark M. Friedman

(57) ABSTRACT

A method of operating an arc lamp. The method includes introducing a primary voltage pulse into the arc lamp, thereby inducing a primary flow of electrical current in the arc lamp. The method also includes introducing at least one secondary voltage pulse into the arc lamp, before the current flow has substantially decayed, thereby inducing a respective secondary flow of electrical current in the arc lamp.

21 Claims, 4 Drawing Sheets

METHOD OF SHAPING LIGHT PULSES EMITTED BY AN ARC LAMP

FIELD AND BACKGROUND OF THE INVENTION

The present invention relates to arc lamps and, more particularly, to a method of shaping the light pulses emitted by an arc lamp.

Pulsed arc lamps have many applications in warfare, in medicine and in the fabrication of semiconductor devices.

FIG. 1 shows a prior art circuit 10 for driving an arc lamp 12. Circuit 10 includes a DC power supply 14, a capacitor 16, a gating switch 18, a diode 20 and a coil 22 connected as shown. In the circuit as drawn in FIG. 1, electrical current from circuit 10 is fed to the anode 24 of arc lamp 12, and the cathode 26 of arc lamp 12 is grounded. Alternatively, electrical current from circuit 10 is fed to cathode 26 and anode 24 is grounded.

Power supply 14 supplies electrical current at a voltage of between 200V and 400V. Capacitor 16 is relatively large, to act as an energy reservoir. In the example shown, capacitor 16 has a capacitance of two millifarads. Gating switch 18 is shown as an insulated gate bipolar transistor (IGBT). Gating switch 18 is opened and closed by a driver 28 to provide pulses of electrical current from power supply 14 to arc lamp 12. Diode 20 serves to discharge coil 22 when gating switch 18 is opened. Coil 22 has a ferrite core and is used to shape the voltage pulses from gating switch 18. Coil 22 also is the secondary coil of a transformer 30 whose primary coil 32 is energized by a trigger pulse source (igniter) 34.

To turn on arc lamp 12, igniter 34 is turned on to create an ignition pulse that provides a high (~20KV) voltage, low current trigger pulse between anode 24 and cathode 26 to create a conductive path from anode 24 to cathode 26 by ionizing the gas, that fills arc lamp 12, between anode 24 and cathode 26. Then an operating voltage pulse at a lower voltage of between 200V and 400V is introduced to arc lamp 12 by closing and then opening gating switch 18. FIG. 2 shows the shapes of the voltage $V_S$ provided by gating switch 18 and the resulting electrical current $I_L$ in arc lamp 12 as a function of time t. $V_S$ is a square voltage pulse that lasts from time $t_1$, when gating switch 18 is closed, to time $t_2$, when gating switch 18 is opened. While gating switch 18 is closed, $I_L$ is $(V_S/L)(t-t_1)$, where L is the inductance of coil 22. Initially, the ferrite core of coil 22 gives coil 22 a high inductance L, so the slope of $I_L(t)$ is very low. When the ferrite core of coil 22 becomes saturated, at time $t_s$, the inductance L of coil 22 falls to the inductance of an air coil, and the slope of $I_L(t)$ increases. $I_L(t)$ rises to a maximum value of $I_{Lmax}$ at time $t_2$. When gating switch 18 is opened at time $t_2$, $I_L(t)$ starts to decay exponentially with a time constant of L/R where R is the effective resistance of diode 20, arc lamp 12, coil 22 and the wires that connect them. The overall shape of the current pulse $I_L$ that actually flows through arc lamp 12 is approximately triangular. The intensity of the light emitted by arc lamp 12 is proportional to $I_L$.

Some applications of pulsed arc lamps require that the shape of the intensity profile of the light pulses be other than triangular, for example square. Perkin-Elmer of Wellesley Mass., USA, has developed a rather complicated circuit for driving an arc lamp in a way that provides light pulses with square intensity profiles. This circuit is described on the World Wide Web at http://optoelectronics.perkinelmer.com/content/RelatedLinks/pulsed_power_applications.pdf This circuit is considerably more complicated than prior art circuit 10.

SUMMARY OF THE INVENTION

It is an object of the present invention to provide a circuit, for driving a pulsed arc lamp, so as to produce light pulses with arbitrary intensity profiles, that is not significantly more complicated than prior art circuit 10.

According to the present invention there is provided a method of operating an arc lamp, including the steps of: (a) introducing a primary voltage pulse into the arc lamp, thereby inducing a primary flow of electrical current in the arc lamp; and (b) before the current flow has substantially decayed, introducing at least one secondary voltage pulse into the arc lamp, thereby inducing a respective secondary flow of electrical current in the arc lamp.

According to the present invention there is provided a current source for operating an arc lamp including: (a) a power supply; (b) a switch for operationally connecting the power supply to the arc lamp; and (c) a timing mechanism for closing and opening the switch in a manner that provides a plurality of voltage pulses from the power supply to the arc lamp so as to induce, in the arc lamp, a flow of electrical current that has a desired shape.

According to the method of the present invention, an arc lamp is energized by introducing a primary operating voltage pulse into the arc lamp, as in the prior art method described above, thereby inducing a primary flow of electrical current in the arc lamp. Then, unlike the prior art method, before the flow of electrical current in the arc lamp has substantially decayed, at least one secondary voltage pulse is introduced into the arc lamp, thereby inducing, for each secondary voltage pulse, a respective secondary electrical current flow in the arc lamp. Preferably, the secondary voltage pulse(s) is/are introduced into the arc lamp starting before the flow of electrical current in the arc lamp has decayed to half of its maximum value.

Preferably, the primary voltage pulse and the secondary voltage pulses are square pulses.

Preferably, a plurality of secondary voltage pulses are introduced into the arc lamp. Each secondary voltage pulse, subsequent to the first secondary voltage pulse, is introduced into the arc lamp before the total electrical current flow induced in the arc lamp by the voltage pulses up to and including the immediately preceding secondary voltage pulse has substantially decayed. Most preferably, each secondary voltage pulse subsequent to the first secondary voltage pulse is introduced into the arc lamp starting before the total current flow induced in the arc lamp has decayed to half of its most recent maximum value.

Preferably, the duration(s) of the secondary voltage pulse (s), and the delay of the secondary voltage pulse(s) relative to the immediately preceding voltage pulse(s) (i.e., the delay of the first secondary voltage pulse relative to the primary voltage pulse, and the delay of each subsequent secondary voltage pulse, if any, relative to the immediately preceding secondary voltage pulse), are selected to give a desired shape to the sum of the primary electrical current flow and the secondary electrical current flow(s). Most preferably, the desired shape is substantially square. Alternatively, the desired shape is substantially Gaussian, or substantially sinusoidal.

Preferably, the primary voltage pulse has a duration of between about 10 microseconds and about 40 microseconds. Preferably, each of the secondary voltage pulses has a duration of between about 10 microseconds and about 20 microseconds. Preferably, the total electrical current flow in the arc lamp has a rise time of between about 10 microseconds and about 20 microseconds during each secondary voltage pulse and/or a fall time, between successive secondary voltage pulses, of between about 50 microseconds and about 100 microseconds. Preferably, the total electrical current flow in the arc lamp has a duration, from when the primary electrical current flow starts until the total electric current flow substantially decays after the end of the last secondary voltage pulse, of between about 200 microseconds and about 10 milliseconds.

The current source of the present invention includes a power supply, a switch for operationally connecting the power supply to an arc lamp, and a timing mechanism for opening and closing the switch in a manner that provides a plurality of voltage pulses from the power supply to the arc lamp so as to induce in the arc lamp a flow of electrical current that has a desired shape.

Preferably, the switch includes an insulated gate bipolar transistor.

Preferably, the switch and the timing mechanism are operative to give the primary voltage pulse a duration of between about 10 microseconds and about 40 microseconds. Preferably, the switch and the timing mechanism are operative to give the secondary voltage pulses respective durations of between about 10 microseconds and about 20 microseconds. Preferably, the current source is operative to give the total flow of electrical current in the arc lamp a rise time of between about 10 microseconds and about 20 microseconds during each secondary voltage pulse and/or a fall time between successive secondary voltage pulses of between about 50 microseconds and about 100 microseconds and/or a duration of between about 200 microseconds and about 10 milliseconds.

The present invention also includes within its scope a source of light pulses that includes both the current source of the present invention and an arc lamp operationally connected to the current source.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a method for pulsing an arc lamp, and a circuit for implementing the method. Specifically, the present invention can be used to produce light pulses whose intensity profiles have any desired shapes.

The principles and operation of an arc lamp driving circuit according to the present invention may be better understood with reference to the drawings and the accompanying description.

Figure 1:
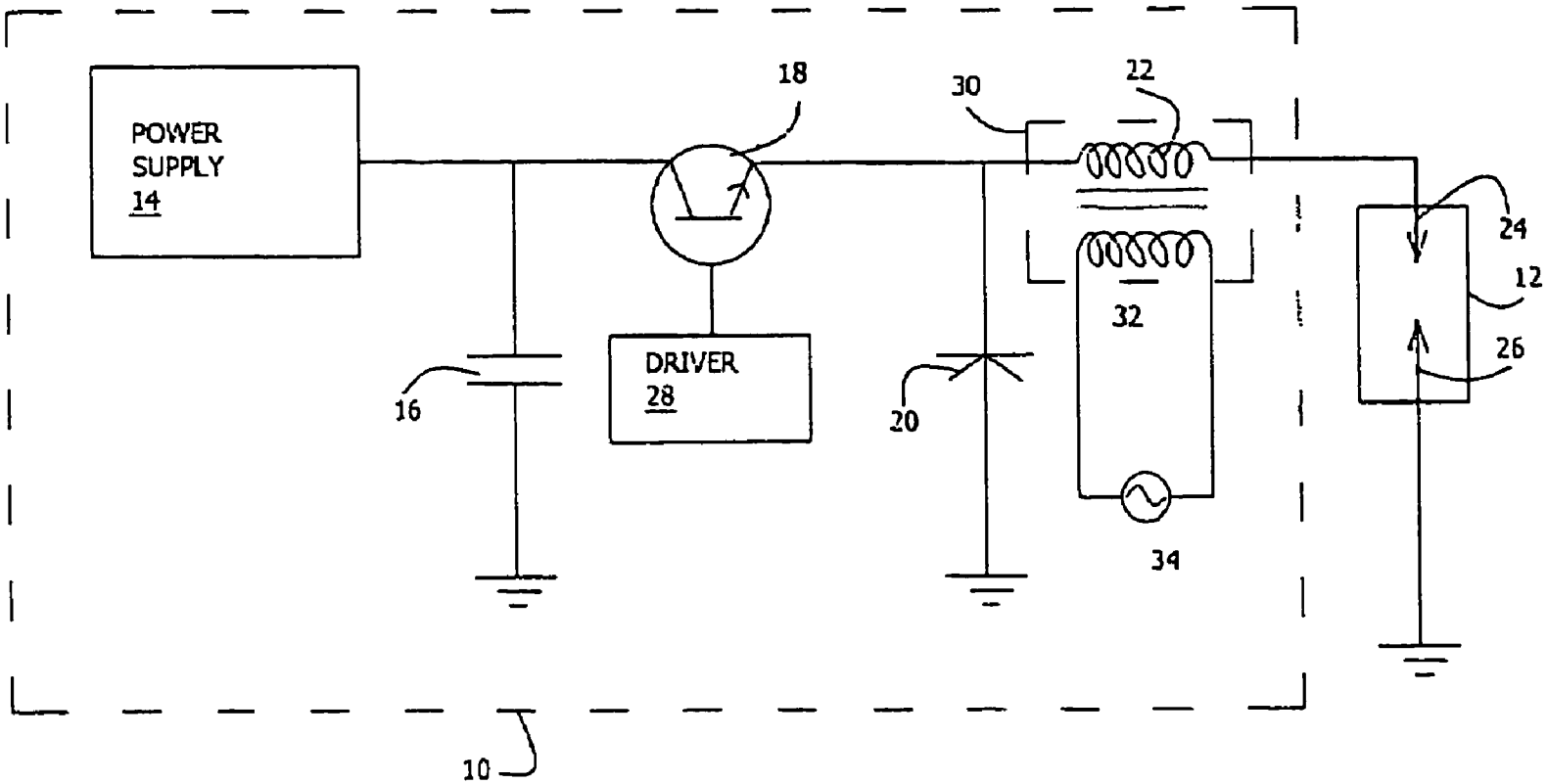
Fig 1 ( PRIOR ART )
FIG. 1 is a circuit diagram of a prior art circuit for driving an arc lamp.
Figure 3:
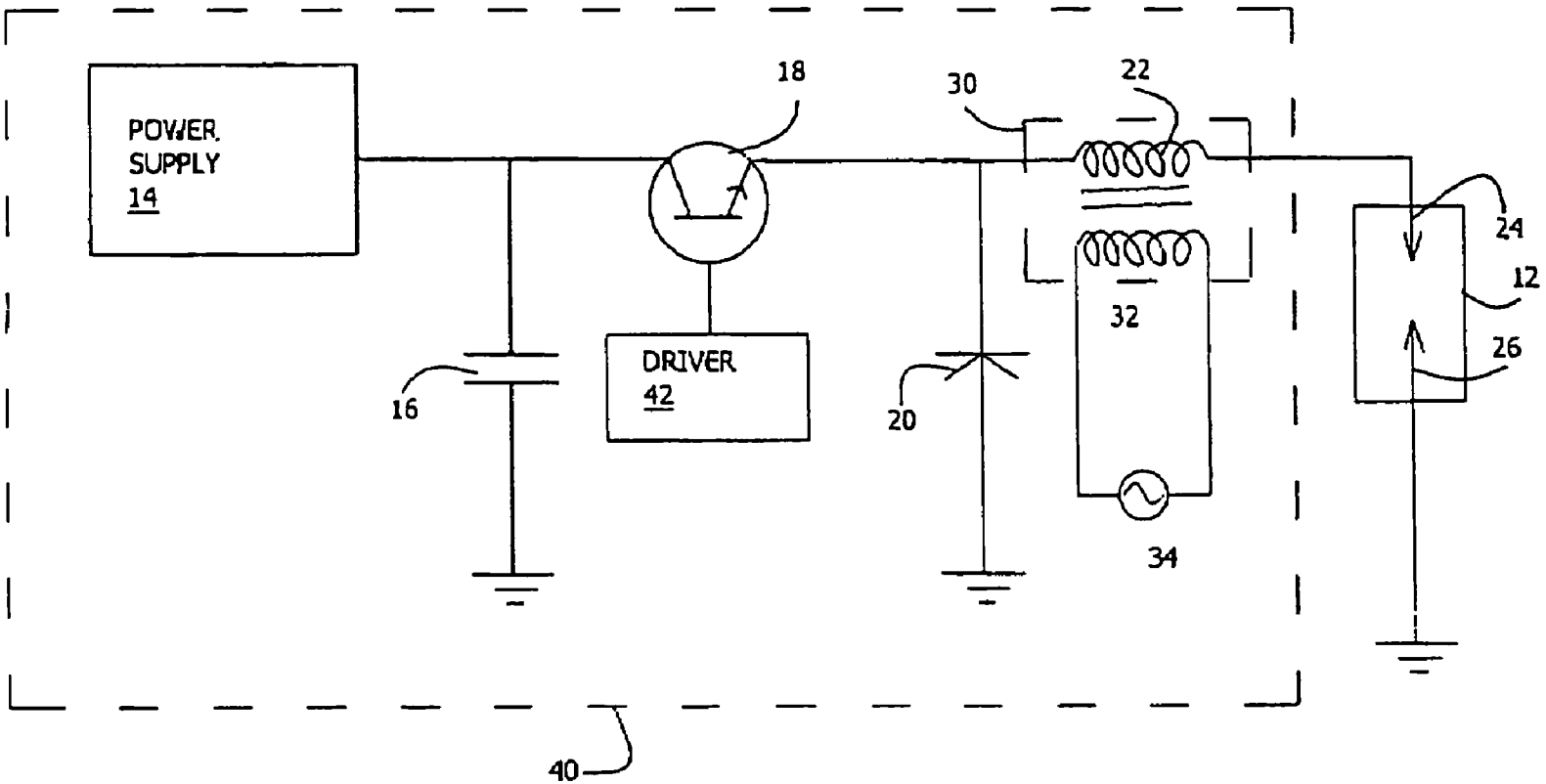
FIG. 3 is a circuit diagram of a circuit of the present invention for driving an arc lamp.

Referring now to the drawings, FIG. 3 is a circuit diagram of a circuit 40 of the present invention for driving arc lamp 12. Circuit 40 is identical to circuit 10, as indicated by the use of identical reference numerals in FIGS. 1 and 3, except for the substitution of a programmable driver 42 for driver 28. Driver 42 is programmable to introduce multiple pulses of operating voltage into arc lamp 12.

Figure 2:
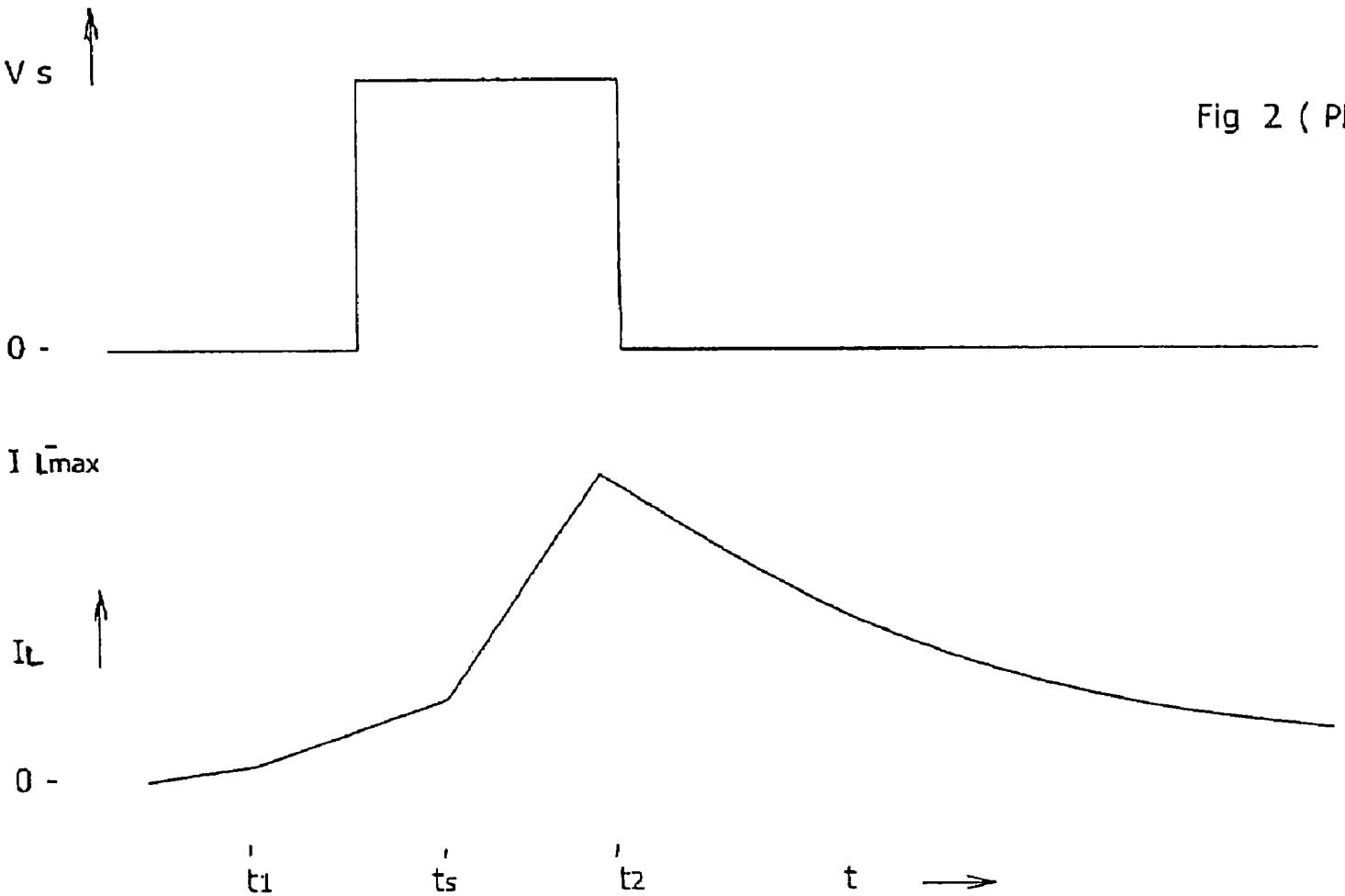
Fig 2 ( PRIOR ART )
FIG. 2 is a plot of a voltage pulse provided to the arc lamp by the circuit of FIG. 1 and a plot of the consequent current flow in the arc lamp.
Figure 4:
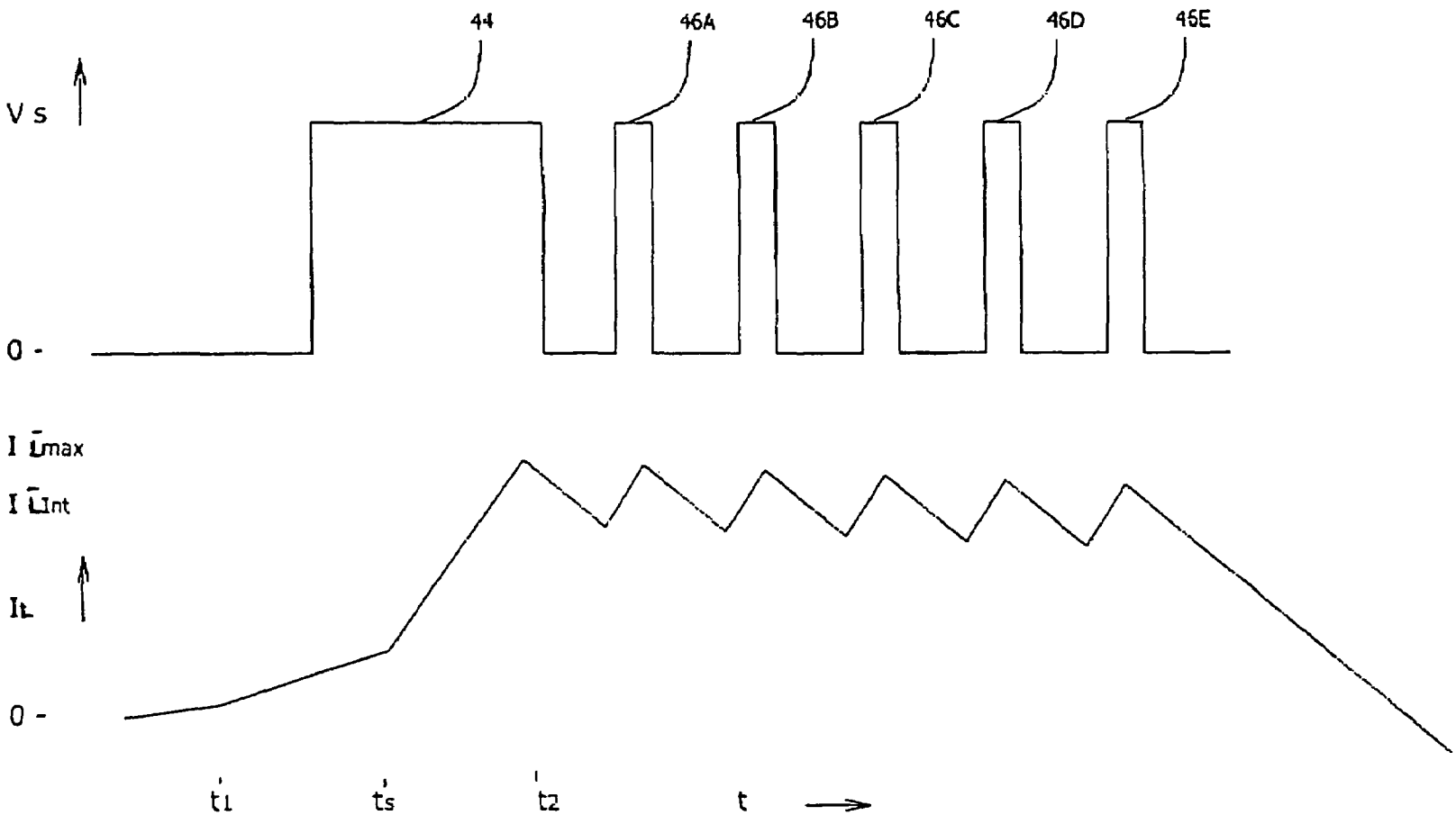
FIG. 4 is a plot of the voltage pulses provided to the arc lamp by the circuit of FIG. 3 and a plot of the consequent current flow in the arc lamp.

FIG. 4 shows an example of multiple pulses of operating voltage $V_S$ provided by using driver 42 to open and close gating switch 18 so as to induce a flow of current $I_L$ in arc lamp 12 that has a substantially square pulse shape. After power supply 34 has been turned on briefly to provide the trigger pulse, driver 42 closes and opens gating switch 18 to provide a primary operating voltage pulse 44 that is substantially identical to the voltage pulse illustrated in FIG. 2. Then, after the current flow $I_L$ in arc lamp 12 has decayed from $I_{Lmax}$ to a preselected intermediate value $I_{Lint}$, driver 42 again closes gating switch 18, and $I_L$ rises with a slope $V_S/L$. When $I_L$ again reaches $I_{Lmax}$, driver 42 opens gating switch 18. In other words, after $I_L$ has decayed from $I_{Lmax}$ to $I_{Lint}$, driver 42 closes and opens gating switch 18 to provide a secondary operating voltage pulse 46A that brings $I_L$ back up to $I_{Lmax}$.

Four more times, as illustrated in FIG. 4, after the current flow $I_L$ in arc lamp 12 has again decayed from $I_{Lmax}$ to $I_{Lint}$, driver 42 again closes and opens gating switch 18 to provide four more secondary operating voltage pulses 46B through 46E that bring $I_L$ back up to $I_{Lmax}$. After the last pulse, gating switch 18 is kept open and $I_L$ is allowed to decay exponentially with the time constant L/R. The resulting current flow $I_L$ in arc lamp 12 has a pulse shape that, rather than being substantially triangular as in the prior art, is substantially square, or at least closer to square than the prior art pulse shape. Correspondingly, the intensity profile of the light emitted by arc lamp 12 is substantially square as a function of time.

It will be clear to those skilled in the art that, in principle, any desired pulse shape can be achieved by the correct selection of the delays between successive operating voltage pulses, and by the correct selection of the duration of the operating voltage pulses. Preferably, the delay between successive operating voltage pulses is such that $I_L$ decays to not less than half of its immediately preceding maximum value between successive operating voltage pulses. This guarantees that the conductive path between anode 24 and cathode 26 is maintained between operating voltage pulses so that additional trigger pulses are not needed.

Preferably, the duration of the primary operating voltage pulse is between about 10 microseconds and about 40 microseconds. Preferably, the duration of each secondary operating voltage pulse is between about 10 microsecond and about 20 microseconds. Preferably, the various components of circuit 40 are such that $I_L$ has a rise time between about 10 microseconds and about 20 microseconds during each secondary operating voltage pulse and a fall time, between successive secondary operating voltage pulses, of between about 50 microseconds and about 100 microseconds. Corresponding parameters for the components of circuit 40 include: for the inductance of coil 22 when its core is saturated: 5 to 10 microhenries; for the inductance of the connecting wires: 5 to 10 microhenries; and for the total resistance of all components to the right of capacitor 16 in FIG. 3: 100 to 200 milliohms.

Preferably, the duration of $I_L$, from $t_1$ until a time to the right of FIG. 4 at which $I_L$ has substantially decayed, is between about 200 microseconds and about 10 milliseconds.

While the invention has been described with respect to a limited number of embodiments, it will be appreciated that many variations, modifications and other applications of the invention may be made.

What is claimed is:

1. A method of operating an arc lamp, comprising the steps of:

(a) introducing a primary voltage pulse into the arc lamp, thereby inducing a primary flow of electrical current in the arc lamp; and (b) before said current flow has substantially decayed, introducing at least one secondary voltage pulse into the arc lamp, thereby inducing a respective secondary flow of electrical current in the arc lamp.

2. The method of claim 1, wherein said primary voltage pulse is a substantially square pulse.

3. The method of claim 1, wherein said at least one secondary voltage pulse is a substantially square pulse.

4. The method of claim 1, wherein a plurality of said secondary voltage pulses are introduced to the arc lamp, with each said secondary voltage pulse subsequent to a first said secondary voltage pulse being introduced to the arc lamp before a sum of said flows, up to and including said respective secondary flow of an immediately preceding said secondary voltage pulse, has substantially decayed.

5. The method of claim 4, wherein each said secondary voltage pulse subsequent to said first secondary voltage pulse is introduced to the arc lamp before a sum of said flows, up to and including said respective secondary flow of an immediately preceding said secondary voltage pulse, has decayed to substantially one-half of an immediately preceding maximum value of said sum.

6. The method of claim 1, wherein each said at least one secondary voltage pulse has a respective duration, and a respective delay, relative to the immediately preceding voltage pulse, selected to give a desired shape to a sum of said primary flow and said at least one secondary flow.

7. The method of claim 6, wherein said desired shape is substantially square.

8. The method of claim 6, wherein said desired shape is substantially Gaussian.

9. The method of claim 6, wherein said desired shape is substantially sinusoidal.

10. The method of claim 1, wherein said at least one secondary voltage pulse is introduced before said current flow has decayed to substantially one-half of a maximum value thereof.

11. The method of claim 1, wherein said primary pulse has a duration of between about 10 microseconds and about 40 microseconds.

12. The method of claim 1, wherein said at least secondary voltage pulse has a duration between about 10 microseconds and about 20 microseconds.

13. The method of claim 1, wherein, during each said secondary voltage pulse, a sum of said flows, up to and including said respective secondary flow of said each secondary voltage pulse, has a rise time of between about 10 microseconds and about 20 microseconds.

14. The method of claim 1, wherein, between successive said secondary voltage pulses, a sum of said flows, up to and including said respective secondary flow of said each secondary voltage pulse, has a fall time of between about 50 microseconds and about 100 microseconds.

15. The method of claim 1, wherein a sum of said primary flow and said secondary flow has a duration of between about 200 microseconds and about 10 milliseconds.

16. A current source for operating an arc lamp comprising:

(a) a power supply;

(b) a switch for operationally connecting said power supply to the arc lamp; and (c) a timing mechanism for closing and opening said switch in a manner that provides a plurality of voltage pulses from the power supply to the arc lamp so as to induce, in the arc lamp, a flow of electrical current that has a desired shape;

wherein said timing mechanism and said switch are operative to give said flow of electrical current, during each voltage pulse subsequent to the first voltage pulse, a rise time of between about 10 microseconds and about 20 microseconds.

17. The current source of claim 16, wherein said switch includes an insulated gate bipolar transistor.

18. The current source of claim 16, wherein said timing mechanism and said switch are operative to provide a first voltage pulse with a duration of between about 10 milliseconds and about 40 milliseconds.

19. The current source of claim 16, wherein said timing mechanism and said switch are operative to provide each voltage pulse subsequent to said first voltage pulse with a duration of between about 10 microseconds and about 20 microseconds.

20. The current source of claim 16, wherein said timing mechanism and said switch are operative to give said flow of electrical current a duration of between about 200 microseconds and about 10 milliseconds.

21. A current source for operating an arc lamp comprising:

(a) a power supply;

(b) a switch for operationally connecting said power supply to the arc lamp; and (c) a timing mechanism for closing and opening said switch in a manner that provides a plurality of voltage pulses from the power supply to the arc lamp so as to induce, in the arc lamp, a flow of electrical current that has a desired shape;

wherein said timing mechanism and said switch are operative to give said flow of electrical current, between successive voltage pulses subsequent to the first voltage pulse, a fall time of between about 50 microseconds and about 100 microseconds.

* * * * *